US011665494B2

(12) United States Patent
Hong et al.

(10) Patent No.: US 11,665,494 B2
(45) Date of Patent: May 30, 2023

(54) BONE CONDUCTION MICROPHONE

(71) Applicant: AAC ACOUSTIC TECHNOLOGIES (SHENZHEN) CO., LTD., Shenzhen (CN)

(72) Inventors: Tingting Hong, Shenzhen (CN); Xing Yu, Shenzhen (CN); Xingfu Chen, Shenzhen (CN)

(73) Assignee: AAC Acoustic Technologies (Shenzhen) Co., Ltd., Shenzhen (CN)

( * ) Notice: Subject to any disclaimer, the term of this patent is extended or adjusted under 35 U.S.C. 154(b) by 0 days.

(21) Appl. No.: 17/542,524

(22) Filed: Dec. 6, 2021

(65) Prior Publication Data

US 2022/0377480 A1 Nov. 24, 2022

(30) Foreign Application Priority Data

May 19, 2021 (CN) ..... 202121085436.7

(51) Int. Cl.

*H04R 25/00* (2006.01)
*H04R 31/00* (2006.01)
*H04R 1/46* (2006.01)

(52) U.S. Cl.

CPC ..... *H04R 31/006* (2013.01); *H04R 1/46* (2013.01); *H04R 2460/13* (2013.01)

(58) Field of Classification Search

CPC ..... H04R 19/04; H04R 7/04; H04R 19/005; H04R 2201/003

See application file for complete search history.

(56) References Cited

U.S. PATENT DOCUMENTS 10,349,188 B2 * 7/2019 Meisel ..... H04R 19/005
2021/0092509 A1 * 3/2021 Rusconi Clerici Beltrami ..... H04R 31/00

* cited by examiner

*Primary Examiner* — Amir H Etesam
(74) *Attorney, Agent, or Firm* — W&G Law Group

(57) ABSTRACT

One of the main objects of the present invention is to provide a bone conduction microphone with simplified structure and easier manufacturing process. To achieve the above-mentioned objects, the present invention provides a bone conduction microphone, including: a housing; a circuit board opposite to the housing; and a vibration assembly locating between the housing and the circuit board. The vibration assembly includes a vibration membrane made of high temperature resistant dustproof breathable material, a weight fixed to the vibration membrane, and a first cavity formed between the vibration membrane and the circuit board. The bone conduction microphone further includes a pressure assembly locating between the vibration assembly and the circuit board for detecting a pressure change generated in the first cavity and converting the pressure change into an electrical signal.

17 Claims, 2 Drawing Sheets

BONE CONDUCTION MICROPHONE

FIELD OF THE PRESENT DISCLOSURE

The present invention relates to the technical field of electroacoustic transducers, and more particularly to a bone conduction microphone.

DESCRIPTION OF RELATED ART

The related bone conduction microphone usually converts the bone conduction signal into a pressure signal by setting a vibration membrane. Then the microphone is picked up and converted into electrical signals, thereby completing the process of sound collection.

However, the vibration membrane in the current bone conduction microphone requires an additional vent hole structure, and the manufacturing process is usually more complicated.

Therefore, it is necessary to provide an improved bone conduction microphone to solve the above-mentioned problems.

SUMMARY OF THE PRESENT INVENTION

One of the main objects of the present invention is to provide a bone conduction microphone with simplified structure and easier manufacturing process.

To achieve the above-mentioned objects, the present invention provides a bone conduction microphone, including: a housing; a circuit board opposite to the housing; and a vibration assembly locating between the housing and the circuit board. The vibration assembly includes a vibration membrane made of high temperature resistant dustproof breathable material, a weight fixed to the vibration membrane, and a first cavity formed between the vibration membrane and the circuit board.

The bone conduction microphone further includes a pressure assembly locating between the vibration assembly and the circuit board for detecting a pressure change generated in the first cavity and converting the pressure change into an electrical signal.

In addition, the bone conduction microphone further includes a bracket connecting the vibration membrane to the circuit board, wherein, the housing includes a main part and an extension part extending from the main part toward the pressure assembly. The vibration membrane locates between the extension part and the bracket. The circuit board, the bracket and the vibration membrane enclose for forming the first cavity. The main part, the extension part and the vibration membrane enclose for forming a second cavity which is acoustically connected to the first cavity through the vibration membrane.

In addition, the bone conduction microphone further includes a gasket locating between the vibration membrane and the bracket, and/or locating between the vibration membrane and the extension part.

In addition, the housing includes a first side facing the pressure assembly. The bone conduction microphone further includes a gasket between the first side surface and the vibration membrane. The housing, the gasket and the vibration membrane enclose for forming a second cavity. The first cavity and the second cavity are acoustically connected through the vibration membrane.

In addition, the bone conduction microphone further includes a gasket, wherein the housing includes a main part and an extension part extending from the main part toward the pressure assembly to the circuit board; the main part, the extension part and the circuit board enclose for forming a second cavity; the vibration membrane. The circuit board and the gasket enclose for forming the first cavity, and the first cavity and the second cavity are acoustically connected through the vibration membrane.

In addition, the gasket is made of elastic material or soft material.

In addition, the weight locates on a side of the vibration membrane away from the pressure assembly, and/or the weight locates on a side of the vibration membrane facing the pressure assembly.

In addition, the vibration membrane is made of dust-proof and breathable materials resistant to temperatures greater than 200° C.

In addition, the bone conduction microphone further includes least one vent hole in the housing.

In addition, the housing includes a sealer for sealing the vent hole.

BRIEF DESCRIPTION OF THE DRAWINGS

Many aspects of the exemplary embodiments can be better understood with reference to the following drawings. The components in the drawing are not necessarily drawn to scale, the emphasis instead being placed upon clearly illustrating the principles of the present disclosure.

DETAILED DESCRIPTION OF THE EXEMPLARY EMBODIMENTS

The present disclosure will hereinafter be described in detail with reference to exemplary embodiments. To make the technical problems to be solved, technical solutions and beneficial effects of the present disclosure more apparent, the present disclosure is described in further detail together with the figures and the embodiments. It should be understood the specific embodiments described hereby are only to explain the disclosure, not intended to limit the disclosure.

Figure 1:
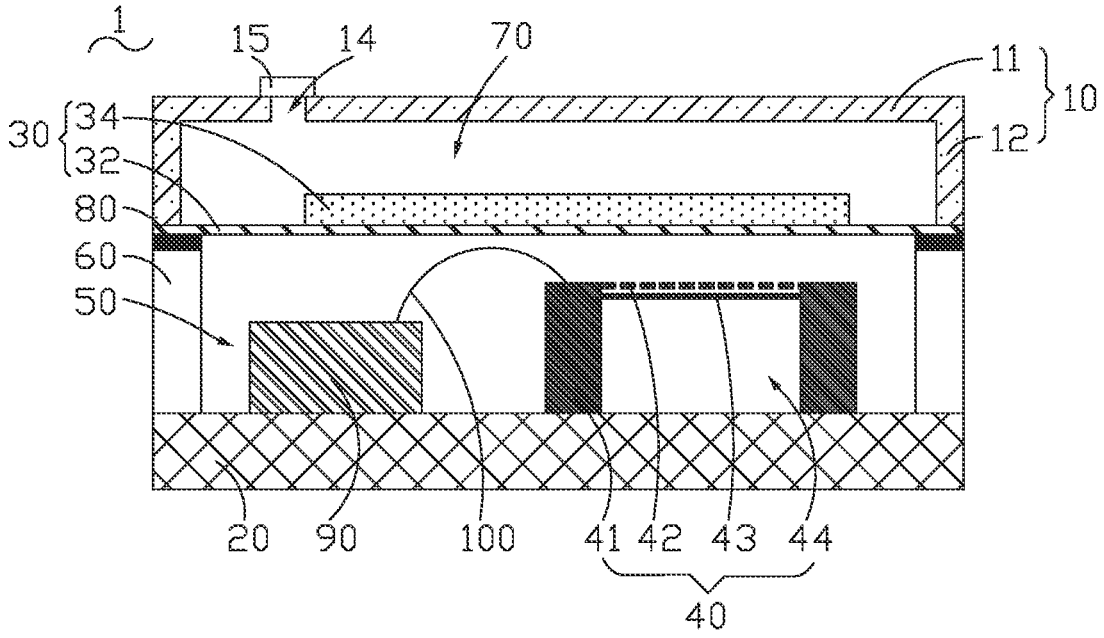
FIG. 1 is a cross-sectional view of a bone conduction microphone in accordance with a first embodiment of the present invention.

Please refer to FIG. 1. A first embodiment of the present invention provides a bone conduction microphone 1. The bone conduction microphone 1 includes a housing 10, a circuit board 20 arranged opposite to the housing 10, a vibration assembly 30 arranged between the housing 10 and the circuit board 20, and a pressure assembly 40 arranged between the vibration assembly 30 and the circuit board 20. The vibration assembly 30 includes a vibration membrane 32 and a weight 34 fixed to the vibration membrane 32. The first cavity 50 is formed between the vibration membrane 32 and the circuit board 20, and the pressure assembly 40 is used to detect the pressure change generated in the first cavity 50 and convert the pressure change into an electrical signal.

The weight 34 generates inertial vibration according to the vibration of the housing 10 or the circuit board 20, which drives the vibration membrane 32 to vibrate, and the pressure in the first cavity 50 changes. The material of vibration membrane 32 is a high temperature resistant dustproof and breathable material. A high temperature resistant dust-proof and breathable material is arranged as the vibration membrane 32, which can balance the air pressure and effectively prevent dust. Moreover, there is no need to open an additional vent hole structure on the vibration membrane 32, which simplifies the manufacturing process of the vibration membrane 32.

The material of the vibration membrane 32 is a breathable material. The air permeability of the vibration membrane 32 can meet the requirement of the circuit board 20 for reflow soldering air leakage. In the prior art, additional holes are usually provided on the vibration membrane to meet the leakage of the circuit board reflow soldering, and the manufacturing process of such a vibration membrane is more complicated. Compared with the prior art, the embodiment of the present invention chooses to adopt the vibration membrane 32 of breathable material. And the vibration membrane 32 with air permeability can leak air during reflow soldering. There is no need for additional openings on the vibration membrane 32 to satisfy reflow soldering leakage. the vibration membrane 32 is integrally formed, which simplifies the manufacturing process of the vibration membrane 32.

In addition, the material of the vibration membrane 32 is a high temperature resistant material. Choosing the vibration membrane 32 made of high temperature resistant material can prevent the circuit board 20 from damaging the vibration membrane 32 during reflow soldering of the soldering device. In this way, the performance of the bone conduction microphone 1 produced is more stable. Exemplarily, considering that the temperature in the constant temperature zone during reflow soldering is about 200° C., the material of the vibration membrane 32 can be a material that can withstand temperatures greater than 200° C.

Further, the material of the vibration membrane 32 is a dustproof material, which can effectively prevent external dust from entering the first cavity 50, thereby preventing external dust from affecting sound collection.

It should be noted that the material of the vibration membrane 32 of the embodiment of the present invention can only be a breathable material. High temperature resistant ventilating materials can also be used, and high temperature resistant and dust-proof ventilating materials can also be used. You can choose according to your needs when you use it to meet the requirements of different users.

In order to more clearly describe the bone conduction microphone 1 provided by the embodiment of the present invention, the structure of the bone conduction microphone 1 of the embodiment of the present invention will be described below with reference to the accompanying drawings.

Exemplarily, please continue to refer to FIG. 1, the bone conduction microphone 1 includes a vibration assembly 30, a pressure assembly 40, a chip 90, and a gold wire 100. The pressure assembly 40, chip 90 and gold wire 100 are all set in the first cavity 50. Chip 90 is electrically connected to pressure assembly 40 through gold wire 100.

Wherein, the vibration assembly 30 can be used as a carrier of bone conduction signals to transmit the bone conduction signals to the bone conduction microphone 1. The vibration assembly 30 includes a vibration membrane 32 and a weight 34. The weight 34 is fixedly connected to the vibration membrane 32, and the vibration membrane 32 is arranged between the housing 10 and the circuit board 20.

The material of the vibration membrane 32 can be a high-temperature resistant dust-proof and breathable material to make the circuit board 20 out of air during the reflow soldering process. Of course, the material of the vibration membrane 32 is not limited to this, and the selection of the material of the vibration membrane 32 can refer to the above description, and will not be repeated. The weight 34 is a component with a certain mass, and the weight 34 can be square, round, special-shaped and other shapes. As shown in FIG. 1, weight 34 may be integrated. Of course, in some other embodiments, the weight can also be set in sections.

The weight 34 is fixedly connected to the vibration membrane 32 so that the weight 34 can drive the vibration membrane 32 to vibrate, so that the pressure assembly 40 picks up the vibration and converts it into an electrical signal. The projection of weight 34 on the vibration membrane 32 can be completely located within the vibration membrane 32. That is to say, the area of the vibration membrane 32 is larger than the area of the weight 34, and this setting can make the vibration membrane 32 have a ventilation margin.

The weight 34 can increase the amplitude of the vibration of the vibration membrane 32, so that the pressure assembly 40 can detect the above-mentioned vibration. It should be noted that the weight 34 can be set above the vibration membrane 32, that is, the side away from the pressure assembly 40. The weight 34 can also be set below the vibration membrane 32, that is, toward the side of the pressure assembly 40. It is also possible to set a weight 34 above and below the vibration membrane 32, as long as the weight 34 can increase the vibration amplitude of the vibration membrane 32, and there is no limitation here. In FIG. 1, the weight 34 is arranged above the vibration membrane 32 for example.

The housing 10 may include a main part 11 and an extension part 12. The extension part 12 extends from the main part 11 toward the direction of the pressure assembly 40 to form a housing 10 with an accommodation space. The main part 11 can be a square flat plate, and the extension part 12 extends from the periphery of the main part 11. The housing 10 is also provided with at least one vent hole 14 for venting during reflow soldering during the manufacturing of the bone conduction microphone 1. The number of vent hole 14 is not limited, as long as it meets the required venting requirements. For example, 9 vent holes 14 evenly distributed on main part 11 can be set to meet the air leakage requirement.

The size and shape of the vent hole 14 are not limited. For example, the vent hole 14 may be a circular hole with a diameter of 60 microns. For another example, the vent hole 14 may be a square hole of 40 μm×40 μm. Of course, the vent hole 14 can also have other shapes and other sizes, and no examples are given here.

It should be noted that after the bone conduction microphone 1 is manufactured, a sealer 15 can be set on the outer side of the housing 10 corresponding to each vent hole 14 position. The sealer 15 is used to seal the vent hole 14 to prevent external air from interfering with the vibration of the vibration membrane 32. For example, sealer 15 can use tape, and use tape to block vent hole 14 to achieve a seal.

The main part 11, extension part 12 and vibration membrane 32 enclose to form a second cavity 70. The bone conduction microphone 1 also includes a bracket 60 connecting the vibration membrane 32 and the circuit board 20. The vibration membrane 32 is arranged between the extension part 12 and the bracket 60.

The circuit board 20, the bracket 60 and the vibration membrane 32 enclose to form a first cavity 50. A first cavity 50 and a second cavity 70 are formed on both sides of the vibration membrane 32, respectively. And the first cavity 50 and the second cavity 70 are connected through the vibration membrane 32. The setting of the first cavity 50 and the second cavity 70 can make the vibration membrane 32 have room for vibration.

The vibration membrane 32 adopts high temperature resistant dust-proof and breathable material and is arranged between the housing 10 and the circuit board 20, so that the air pressure can be balanced and the sound collection performance of the bone conduction microphone 1 is better.

The circuit board 20 may also be referred to as a PCB (Printed Circuit Board, printed circuit board), which is a support for electronic components, and may also be understood as a carrier for electrical interconnection of electronic components. The circuit board 20 is arranged on the side of the vibration membrane 32 away from the housing 10. The chip 90 and the pressure assembly 40 are arranged in the first cavity 50. The chip 90 and the pressure assembly 40 are arranged on the circuit board 20 at intervals. Chip 90 and pressure assembly 40 are connected by gold wire 100. Chip 90 is used to process the audio signal of pressure assembly 40.

In addition, bone conduction microphone 1 also includes gasket 80. The gasket 80 can be thin, and the gasket 80 can be made of elastic or soft materials. The gasket 80 can be set at the connecting position between the vibration membrane 32 and the bracket 60. The gasket 80 can also be set at the position where the vibration membrane 32 and the extension part 12 are connected. It is also possible to set a gasket 80 at both the position where the vibration membrane 32 is connected to the housing 10 and the position where the vibration membrane 32 is connected to the bracket 60. The gasket 80 is arranged at the position connected to the vibration membrane 32 to buffer and protect the vibration membrane 32.

The pressure assembly 40 may adopt, but is not limited to, an MEMS (Micro-Electro-Mechanical System) microphone. When the bone conduction signal is transmitted to the product in the form of vibration acceleration, the weight 34 in the vibration assembly 30 undergoes relative displacement with the MEMS microphone due to inertial action. The first cavity 50 between the two is compressed and stretched, and the pressure changes periodically. The pressure signal is picked up by a high-sensitivity MEMS microphone and converted into an electrical signal. Since then, the sound signal collection process is completed.

The pressure assembly 40 may include a main body 41, a back plate 42 and a diaphragm 43. The back plate 42 includes a plurality of sound inlet holes, and the sound signal or vibration signal enters the pressure assembly 40 through the sound inlet hole. The diaphragm 43 is used to generate vibration according to the pressure change in the first cavity 50 to collect the pressure change. The pressure assembly 40 is connected to the circuit board 20 through the main body 41. The circuit board 20, the main body 41 and the diaphragm 43 surround a back cavity 44 forming a pressure assembly 40. The back cavity 44 is used to provide a vibrating space when the diaphragm 43 vibrates to collect the pressure change in the first cavity 50.

Chip 90 can use ASIC (Application Specific Integrated Circuit, application specific integrated circuit) chip, ASIC chip is usually designed according to specific user requirements and specific electronic system needs. Compared with general-purpose integrated circuits, ASICs have the advantages of smaller size, lower power consumption, high reliability, superior performance, strong confidentiality, and low cost in mass production. Chip 90 and pressure assembly 40 are connected through gold wire 100, so that chip 90 can process the audio signal of pressure assembly 40. In addition, the chip 90 and the pressure assembly 40 are approximately symmetrically arranged on the circuit board 20 to provide an external bias to the pressure assembly 40. Such a setting can not only physically balance the pressure assembly 40 and chip 90 so that they will not deviate. Moreover, the pressure assembly 40 can maintain stable acoustic and electrical parameters during operation, thereby making the performance of the bone conduction microphone 1 of the embodiment of the present invention better.

It should be noted that the structure of the bone conduction microphone 1 provided by the embodiment of the present invention is not limited to the above-mentioned structure.

Figure 2:
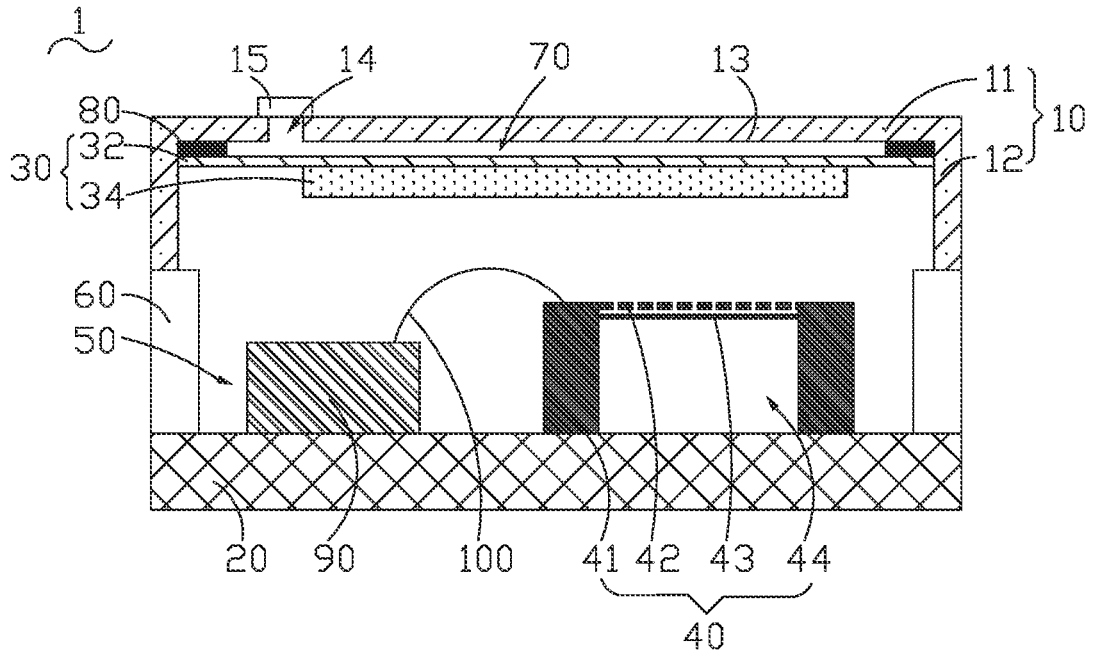
FIG. 2 is a cross-sectional view of a bone conduction microphone in accordance with a second embodiment of the present invention.

Exemplarily, please refer to FIG. 2. A bone conduction microphone provided by a second embodiment of the present invention. The bone conduction microphone 1 includes a housing 10, a circuit board 20 arranged opposite to the housing 10, a vibration assembly 30 arranged between the housing 10 and the circuit board 20, and a pressure assembly arranged between the vibration assembly 30 and the circuit board 20. The vibration assembly 30 includes a vibration membrane 32 and a weight 34 fixed to the vibration membrane 32. The first cavity 50 is formed between the vibration membrane 32 and the circuit board 20, and the pressure assembly 40 is used to detect the pressure change generated in the first cavity 50 and convert the pressure change into an electrical signal.

The weight 34 generates inertial vibration according to the vibration of the housing 10 or the circuit board 20, and drives the vibration membrane 32 to vibrate to cause pressure changes in the first cavity 50. The material of vibration membrane 32 is a high temperature resistant dustproof and breathable material. A high temperature resistant dust-proof and breathable material is arranged as the vibration membrane 32, which can balance the air pressure and effectively prevent dust. Moreover, there is no need to open an additional vent hole structure on the vibration membrane 32, which simplifies the manufacturing process of the vibration membrane 32. The bone conduction microphone 1 also includes a chip 90 and a gold wire 100. The pressure assembly 40, chip 90 and gold wire 100 are all set in the first cavity 50. Chip 90 is electrically connected to pressure assembly 40 through gold wire 100.

Wherein, the vibration assembly 30 can be used as a carrier of bone conduction signals to transmit the bone conduction signals to the pressure assembly 40. The vibration assembly 30 includes a vibration membrane 32 and a weight 34. The weight 34 is fixedly connected to the vibration membrane 32. The vibration membrane 32 is arranged between the housing 10 and the circuit board 20.

Wherein, the description of vibration membrane 32 and weight 34 can refer to the structure shown in FIG. 1, which will not be repeated here. In FIG. 2, the weight 34 is arranged below the vibration membrane 32 as an example for illustration, and it should not be understood as a restriction on the location of the weight 34.

The housing 10 includes a first side surface 13 facing the pressure assembly 40. It can be understood that the first side 13 facing the pressure assembly 40 is the inner side of the housing 10. The housing 10 also includes an main part 11 and an extension part 12. The extension part 12 extends from the main part 11 toward the pressure assembly 40 to form an accommodation space for the housing 10.

The housing 10 is also provided with at least one vent hole 14 and a sealer 15 for sealing the vent hole 14 for air leakage during reflow soldering during the manufacturing of the bone conduction microphone 1. The vent hole 14 and the sealer 15 can refer to FIG. 1 and the above description of the vent hole 14 and the sealer 15, which will not be repeated here.

The extension part 12 of the housing 10 is connected to the circuit board 20. The vibration assembly 30 may also include a bracket 60, and the bracket 60 may be set between the extension part 12 and the circuit board 20. It should be noted that the extension part 12 of the housing 10 can be directly connected to the circuit board 20, or a bracket 60 can be added to connect the extension part 12 to the circuit board 20. The embodiment of the present invention is described by taking the addition of a bracket 60 as an example. The vibration membrane 32, the extension part 12, the bracket 60 and the circuit board 20 enclose to form a first cavity 50. Both the pressure assembly 40 and the chip 90 are set in the first cavity 50. The chip 90 and the pressure assembly 40 are arranged on the circuit board 20 at intervals.

The bone conduction microphone 1 also includes a gasket 80, which can be thin. The gasket 80 can be made of elastic material or soft material. The vibration membrane 32 is arranged in the containing space of the housing 10. In addition, the vibration membrane 32 is connected to the first side surface 13 of the housing 10 through a gasket 80. The vibration membrane 32, main part 11 and the gasket 80 enclose to form a second cavity 70. A first cavity 50 and a second cavity 70 are formed on both sides of the vibration membrane 32, respectively. The first cavity 50 and the second cavity 70 are connected through a vibration membrane 32. The setting of the first cavity 50 and the second cavity 70 can make the vibration membrane 32 have room for vibration. The vibration membrane 32 is made of high-temperature resistant dust-proof and breathable material and is arranged between the housing 10 and the circuit board 20, which can balance the air pressure and make the sound collection performance of the bone conduction microphone 1 better.

The pressure assembly 40 can be, but is not limited to, an MEMS microphone. When the bone conduction signal is transmitted to the product in the form of vibration acceleration, the weight 34 in the vibration assembly 30 undergoes relative displacement with the MEMS microphone due to inertial action. The first cavity 50 between the two is compressed and stretched, and the pressure changes periodically. The pressure signal is picked up by a high-sensitivity MEMS microphone and converted into an electrical signal. Since then, the sound signal collection process is completed. Chip 90 and pressure assembly 40 are connected through gold wire 100, so that chip 90 can process the audio signal of pressure assembly 40. For the description of the pressure assembly 40 and chip 90, refer to FIG. 1 and the above description, which will not be repeated here.

Figure 3:
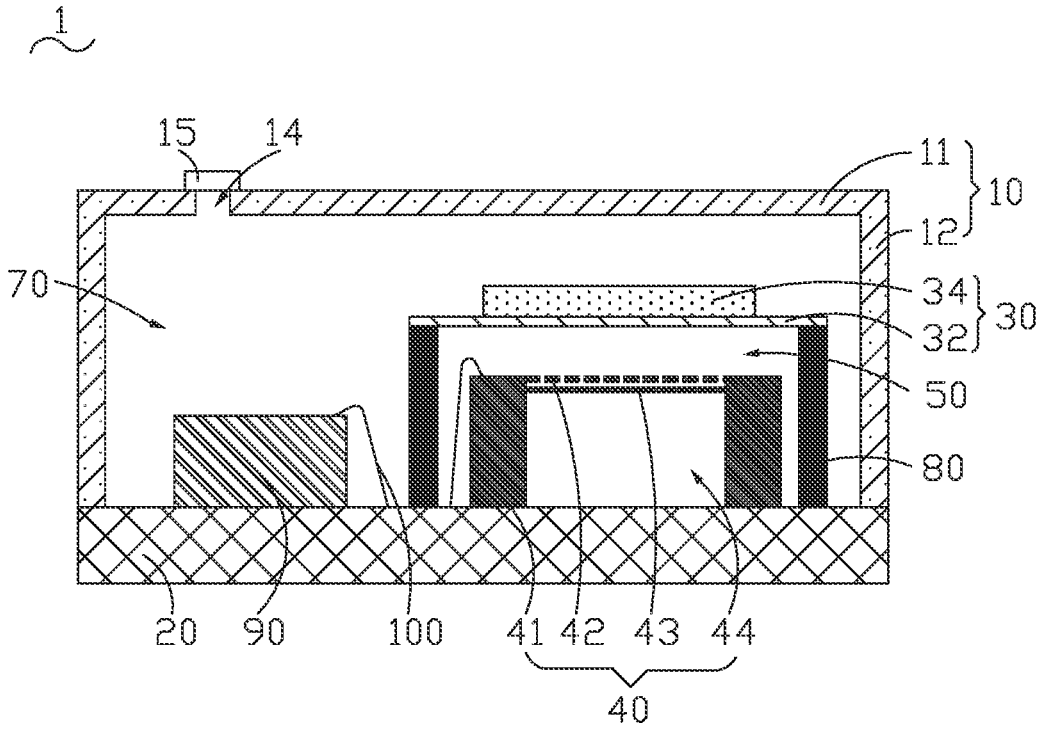
FIG. 3 is a cross-sectional view of a bone conduction microphone in accordance with a third embodiment of the present invention.

Exemplarily, please refer to FIG. 3. A bone conduction microphone provided by a third embodiment of the present invention. The bone conduction microphone 1 includes a housing 10, a circuit board 20 arranged opposite to the housing 10, a vibration assembly 30 arranged between the housing 10 and the circuit board 20, and a pressure assembly arranged between the vibration assembly 30 and the circuit board 20. The vibration assembly 30 includes a vibration membrane 32 and a weight 34 fixed to the vibration membrane 32. A first cavity 5 is formed between the vibration membrane 32 and the circuit board 20.

The pressure assembly 40 is used to detect the pressure change generated in the first cavity 50 and convert the pressure change into an electrical signal. The weight 34 generates inertial vibration according to the vibration of the housing 10 or the circuit board 20, and drives the vibration membrane 32 to vibrate to cause pressure changes in the first cavity 50. The material of vibration membrane 32 is a high temperature resistant dustproof and breathable material. A high temperature resistant dust-proof and breathable material is arranged as the vibration membrane 32, which can balance the air pressure and effectively prevent dust.

Moreover, there is no need to open an additional vent hole structure on the vibration membrane 32, which simplifies the manufacturing process of the vibration membrane 32. The bone conduction microphone 1 also includes a chip 90 and a gold wire 100. The pressure assembly 40 is arranged in the first cavity 50. Chip 90 is electrically connected to pressure assembly 40 through gold wire 100.

Wherein, the vibration assembly 30 can be used as a carrier of bone conduction signals to transmit the bone conduction signals to the pressure assembly 40. The vibration assembly 30 includes a vibration membrane 32 and a weight 34. The weight 34 is fixedly connected to the vibration membrane 32, and the vibration membrane 32 is arranged between the housing 10 and the circuit board 20.

The material of the vibration membrane 32 of the embodiment of the present invention can be a high-temperature resistant dust-proof and breathable material, so as to make the circuit board 20 vented during the reflow soldering process. The selection of the material of the vibration membrane 32 can refer to the above description, and will not be repeated. The weight 34 is a component with a certain mass, and the weight 34 can be square, round, special-shaped and other shapes. For the design of weight 34, reference may be made to the introduction of weight 34 in FIG. 1, which will not be repeated here.

The housing 10 includes a main part 11 and an extension part 12. The extension part 12 extends from the main part 11 toward the direction of the pressure assembly 40 to form a housing 10 with an accommodation space. The main part 11 can be a square flat plate, and the extension part 12 extends from the periphery of the main part 11. The extension part 12 is connected to the periphery of the circuit board 20. The main part 11, the extension part 12 and the circuit board 20 enclose to form a second cavity 70. The chip 90 and the vibration assembly 30 are both set in the second cavity 70. And the pressure assembly 40 is arranged in the first cavity 50.

The housing 10 is also provided with at least one vent hole 14 and a sealer 15 for sealing the vent hole 14. The vent hole 14 and the sealer 15 can refer to FIG. 1 and the above description of the vent hole 14 and the sealer 15, which will not be repeated here.

The bone conduction microphone 1 also includes a gasket 80. The vibration membrane 32 can be connected to the circuit board 20 through the gasket 80. The vibration membrane 32, the gasket 80 and the circuit board 20 are enclosed to form a first cavity 50. The pressure assembly 40 is arranged in the first cavity 50. The chip 90 is arranged in the second cavity 70 and is separated from the pressure assembly 40 by a gasket 80. Chip 90 and pressure assembly 40 are connected through gold wire 100 and circuit board 20.

The pressure assembly 40 can be, but is not limited to, an MEMS microphone. When the bone conduction signal is transmitted to the product in the form of vibration acceleration, the weight 34 in the vibration assembly 30 undergoes relative displacement with the MEMS microphone due to inertial action. The first cavity 50 between the two is compressed and stretched, and the pressure changes periodically. The pressure signal is picked up by a high-sensitivity MEMS microphone and converted into an electrical signal. Since then, the sound signal collection process is completed. Chip 90 and pressure assembly 40 are connected through gold wire 100, so that chip 90 can process the audio signal of pressure assembly 40. For the description of the pressure assembly 40 and chip 90, refer to FIG. 1 and the above description, which will not be repeated here.

It is to be understood, however, that even though numerous characteristics and advantages of the present exemplary embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A bone conduction microphone, including:

a housing;

a circuit board opposite to the housing;

a vibration assembly locating between the housing and the circuit board, including a vibration membrane made of high temperature resistant dustproof breathable material, a weight fixed to the vibration membrane, and a first cavity formed between the vibration membrane and the circuit board;

a pressure assembly locating between the vibration assembly and the circuit board for detecting a pressure change generated in the first cavity and converting the pressure change into an electrical signal;

a bracket connecting the vibration membrane to the circuit board;

wherein, the housing includes a main part and an extension part extending from the main part toward the pressure assembly; the vibration membrane locates between the extension part and the bracket; the circuit board, the bracket and the vibration membrane enclose for forming the first cavity; the main part, the extension part and the vibration membrane enclose for forming a second cavity which is acoustically connected to the first cavity through the vibration membrane.

2. The bone conduction microphone as described in claim 1 further including a gasket locating between the vibration membrane and the bracket, and/or locating between the vibration membrane and the extension part.

3. The bone conduction microphone as described in claim 1, wherein the weight locates on a side of the vibration membrane away from the pressure assembly, and/or the weight locates on a side of the vibration membrane facing the pressure assembly.

4. The bone conduction microphone as described in claim 1, wherein the vibration membrane is made of dust-proof and breathable materials resistant to temperatures greater than 200° C.

5. The bone conduction microphone as described in claim 1 further including least one vent hole in the housing.

6. The bone conduction microphone as described in claim 5, wherein the housing includes a sealer for sealing the vent hole.

7. A bone conduction microphone, including:

a housing;

a circuit board opposite to the housing;

a vibration assembly locating between the housing and the circuit board, including a vibration membrane made of high temperature resistant dustproof breathable material, a weight fixed to the vibration membrane, and a first cavity formed between the vibration membrane and the circuit board;

a pressure assembly locating between the vibration assembly and the circuit board for detecting a pressure change generated in the first cavity and converting the pressure change into an electrical signal;

a gasket;

wherein the housing includes a first side facing the pressure assembly; the gasket locates between the first side surface and the vibration membrane; the housing, the gasket and the vibration membrane enclose for forming a second cavity; the first cavity and the second cavity are acoustically connected through the vibration membrane.

8. The bone conduction microphone as described in claim 7, wherein the weight locates on a side of the vibration membrane away from the pressure assembly, and/or the weight locates on a side of the vibration membrane facing the pressure assembly.

9. The bone conduction microphone as described in claim 7, wherein the vibration membrane is made of dust-proof and breathable materials resistant to temperatures greater than 200° C.

10. The bone conduction microphone as described in claim 7 further including least one vent hole in the housing.

11. The bone conduction microphone as described in claim 10, wherein the housing includes a sealer for sealing the vent hole.

12. A bone conduction microphone, including:

a housing;

a circuit board opposite to the housing;

a vibration assembly locating between the housing and the circuit board, including a vibration membrane made of high temperature resistant dustproof breathable material, a weight fixed to the vibration membrane, and a first cavity formed between the vibration membrane and the circuit board;

a pressure assembly locating between the vibration assembly and the circuit board for detecting a pressure change generated in the first cavity and converting the pressure change into an electrical signal;

a gasket;

wherein the housing includes a main part and an extension part extending from the main part toward the pressure assembly and connect to the circuit board; the main part, the extension part and the circuit board enclose for forming a second cavity; the vibration membrane, the circuit board and the gasket enclose for forming the first cavity, and the first cavity and the second cavity are acoustically connected through the vibration membrane.

13. The bone conduction microphone as described in claim 12, wherein the gasket is made of elastic material or soft material.

14. The bone conduction microphone as described in claim 12, wherein the weight locates on a side of the vibration membrane away from the pressure assembly, and/or the weight locates on a side of the vibration membrane facing the pressure assembly.

15. The bone conduction microphone as described in claim 12, wherein the vibration membrane is made of dust-proof and breathable materials resistant to temperatures greater than 200° C.

16. The bone conduction microphone as described in claim 12 further including least one vent hole in the housing.

17. The bone conduction microphone as described in claim 16, wherein the housing includes a sealer for sealing the vent hole.

* * * * *